US005540000A

United States Patent [19]

Rosenburgh et al.

[11] Patent Number: 5,540,000

[45] Date of Patent: Jul. 30, 1996

[54] METHOD OF PHOTOSENSITIVE MATERIAL DRYING

[75] Inventors: John H. Rosenburgh, Hilton; Heath A. Dowling, Webster; Joseph A. Manico, Rochester; David L. Patton, Webster; Ralph L. Piccinino, Jr., Rush, all of N.Y.

[73] Assignee: Eastman Kodak Company, Rochester, N.Y.

[21] Appl. No.: 438,298

[22] Filed: May 10, 1995

[51] Int. Cl.[6] ..... F26B 3/00

[52] U.S. Cl. ..... 34/491; 34/446

[58] Field of Search ..... 34/491, 445, 446, 34/493, 494, 495, 496, 497

[56] References Cited

U.S. PATENT DOCUMENTS 3,214,845 11/1965 Huffman .
3,370,360 2/1968 Smith .
4,245,397 1/1981 Laar et al. .
4,821,427 4/1989 Chern .
4,916,829 4/1990 Takiue et al. .

*Primary Examiner*—John T. Kwon
*Attorney, Agent, or Firm*—C. J. Fildes & Co., P.C.

[57] ABSTRACT

A photosensitive material dryer apparatus including a drying chamber and a first drying application device wherein a photosensitive material having a photosensitive material conductivity drying profile is dried following a wet chemical process includes a sensor for electronically measuring and sensing the conductivity of the photosensitive material, and a controller in communication with the sensor and the drying application device for regulating the drying application device based on the sensed conductivity of the photosensitive material.

4 Claims, 3 Drawing Sheets

METHOD OF PHOTOSENSITIVE MATERIAL DRYING

FIELD OF THE INVENTION

This invention relates to a photographic processing apparatus and more particularly to an apparatus for and method of drying photosensitive material such as film.

BACKGROUND OF THE INVENTION

It is known in the art relating to photographic processing to dry a photosensitive material following a wet chemical process such as developing. At present, the drying of photosensitive materials is most commonly accomplished by surrounding the wet photosensitive material with heated air. Other less common drying techniques include radiant heating, microwave drying heating, and combinations thereof.

Drying time is dependent on the method of drying used and the intensity of the application of the method. The application, for example, of super heated air, can damage the photosensitive material. This damage is evidenced in emulsion stress cracking, uneven gloss, excessive photosensitive material blistering, and burned spots on emulsions.

Alternatively the application of low heat or no heat and low or no circulation air can also have damaging effects on the photosensitive material. This is evidenced by a soft tacky emulsion which lends the photographic material to being easily scratched or damaged; processor transport jams due to the tacky, sticky undried emulsion; gloss variation; and prints and films sticking to one another.

The recurring problem with drying photosensitive materials is the inability to determine when the photosensitive material is properly dry. The need exists to predict or actually know when the drying technology application will produce the desired end effect, i.e. dryness of the photosensitive material. Conventional drying technology requires the constant monitoring of the dryer temperature to accommodate ambient operational site conditions such as relative humidity, temperature, and type of material being dried.

Current methods of dryer control require the measuring of ambient conditions and the measuring of drying chamber conditions and using the measurements to calibrate the drying apparatus. These methods have an unacceptable margin of error and require sophisticated RH instruments that require frequent calibration. The only time-proven test for drying in practice has been to increase drying application intensity to the point where two dried emulsions pressed face to face will not stick to or damage each other. Frequent visual examination is required and the dryer must be subsequently adjusted to assure the correct drying effects are obtained.

SUMMARY OF THE INVENTION

The present invention provides a photosensitive material dryer apparatus for and method of determining when a photosensitive material is dry by electronically measuring the conductivity, or resistance to conductivity of the photosensitive material and drying the photosensitive material in response to the conductivity determination. Such an apparatus and method takes into account that a photosensitive material containing a high moisture content is more conductive than a photosensitive material containing a low or minimum moisture amount. Accordingly, the present invention provides an inexpensive resistance measurement device whereby the drying process can be quantified and the resistance data used to predict the amount of dryer application to be used and the time required to adequately dry the photosensitive material, independent of ambient dryer site conditions.

More specifically, a photosensitive material dryer apparatus includes a drying chamber and a drying application device wherein a photosensitive material having a photosensitive material conductivity drying profile is dried following a wet chemical process. The photosensitive material dryer includes a sensor for sensing the photosensitive material dryness. The sensor includes an electrical resistance measurement device for electronically measuring the conductivity of the photosensitive material. A controller, in communication with the sensor and also with the drying application device, regulates the drying application device based on a comparison of sensed photosensitive material dryness and the photosensitive material conductivity drying profile, independent of ambient dryer site conditions.

A method of drying the photosensitive material following a wet chemical process in the photosensitive material dryer includes the steps of:

electronically measuring the conductivity of the photosensitive material;

comparing the measured conductivity with the photosensitive material conductivity drying profile to determine the duration and amount of drying application required to dry the photosensitive material; and regulating the drying application device in response to the required drying application.

These and other features and advantages of the invention will be more fully understood from the following detailed description of the invention taken together with the accompanying drawings.

DETAILED DESCRIPTION OF THE INVENTION

Figure 1:
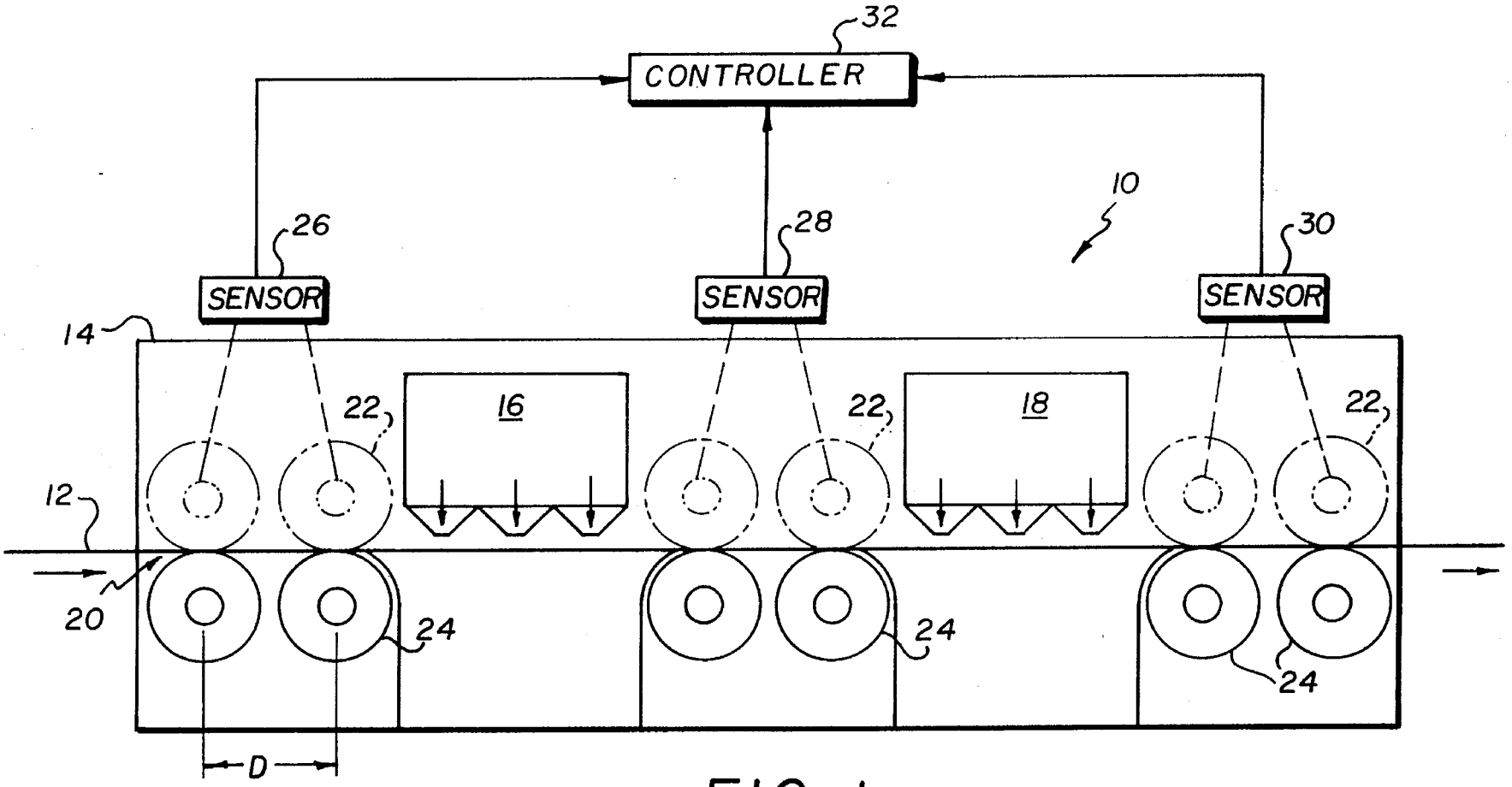
FIG. 1 is a schematic view illustrating a photosensitive material dryer constructed in accordance with the present invention.

Referring now to the drawings in detail, numeral 10 generally indicates a photosensitive material dryer apparatus for drying a photosensitive material 12, such as an emulsion, following a wet chemical process such as developing. The photosensitive material 12 has an associated photosensitive material conductivity drying profile which represents the preferred drying profile for that material. The preferred drying profile is indicative of the electrical resistance of the emulsion 12 as a function of the percentage of stabilizer absorbed in the photosensitive material during drying.

Figure 2:
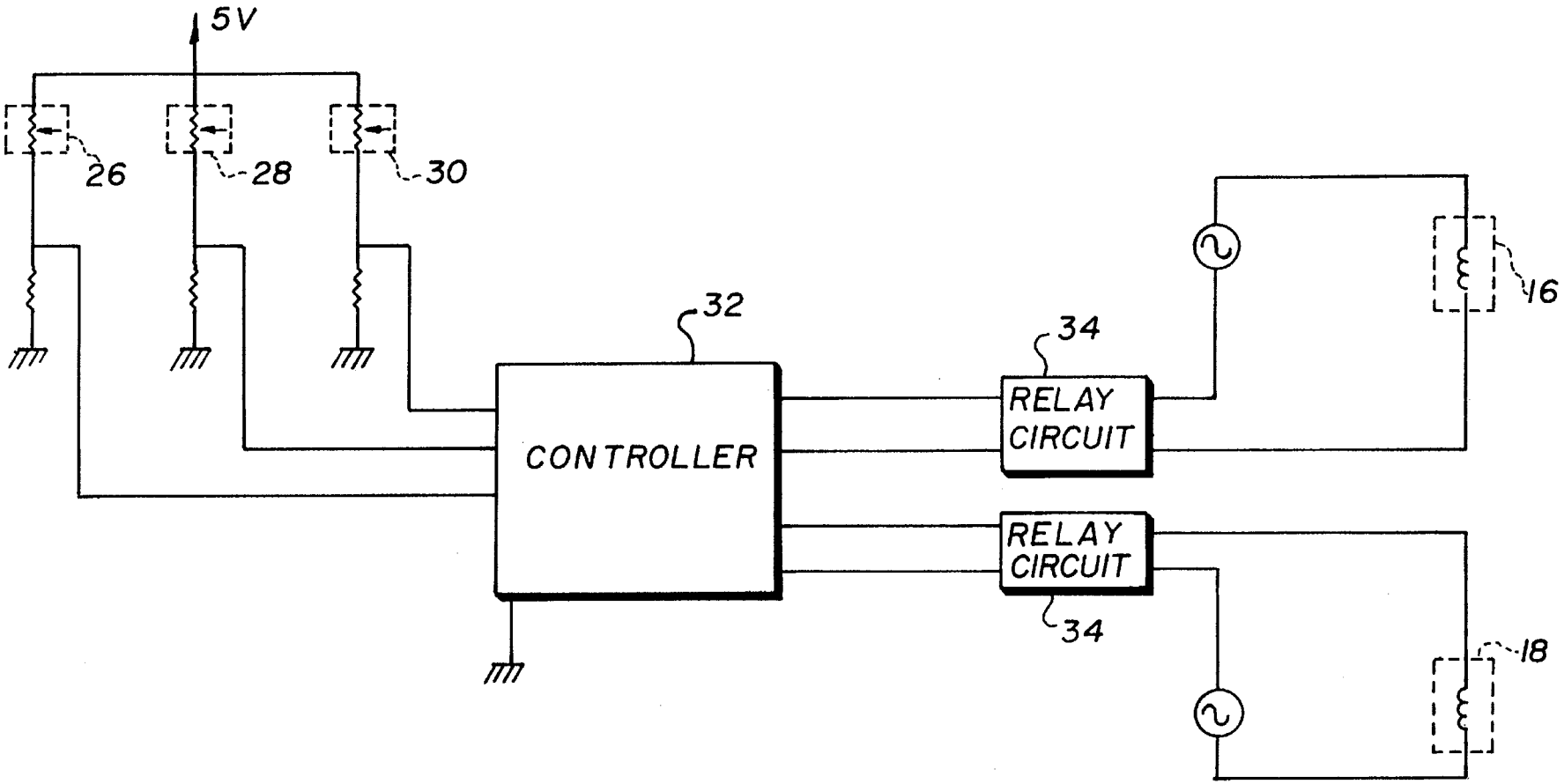
FIG. 2 is an electrical schematic view of a dryer control circuit.

With reference to FIGS. 1 and 2, the photosensitive material dryer apparatus 10 includes a drying chamber 14 through which the photosensitive material 12 is conveyed in a direction of conveyance represented by arrows, a first drying application device 16, and a second drying application device 18. The first and second drying application devices 16, 18 illustrated are forced hot air devices. However, known radiant heating, or microwave heating devices can also be used. The photosensitive material 12 is conveyed through sets 20 of spaced rollers. Each set consisting of an upper conductivity roller 22 and a lower nonconductive roller 24. Preferably the conductivity roller 22 is made of a conductive material such as stainless steel material and the lower roller 24 is made of an elastomer material.

Sensors 26, 28, and 30 are in communication with adjacent pairs of conductivity rollers 22 for sensing the conductivity of the photosensitive material 12 between the respective adjacent pairs of conductivity rollers to sense conductivity and thereby dryness at spaced locations in the dryer apparatus 10. The distance between conductivity rollers 22 in each adjacent pair is fixed and of a known distance value D. The conductivity of the photosensitive material 12 is measured through distance D and compared with the photosensitive material drying profile as hereinafter described. The lower the conductivity, the lower the moisture content in the photosensitive material 12. The higher the conductivity measured, the higher the moisture content in a photosensitive material 12.

Figure 3:
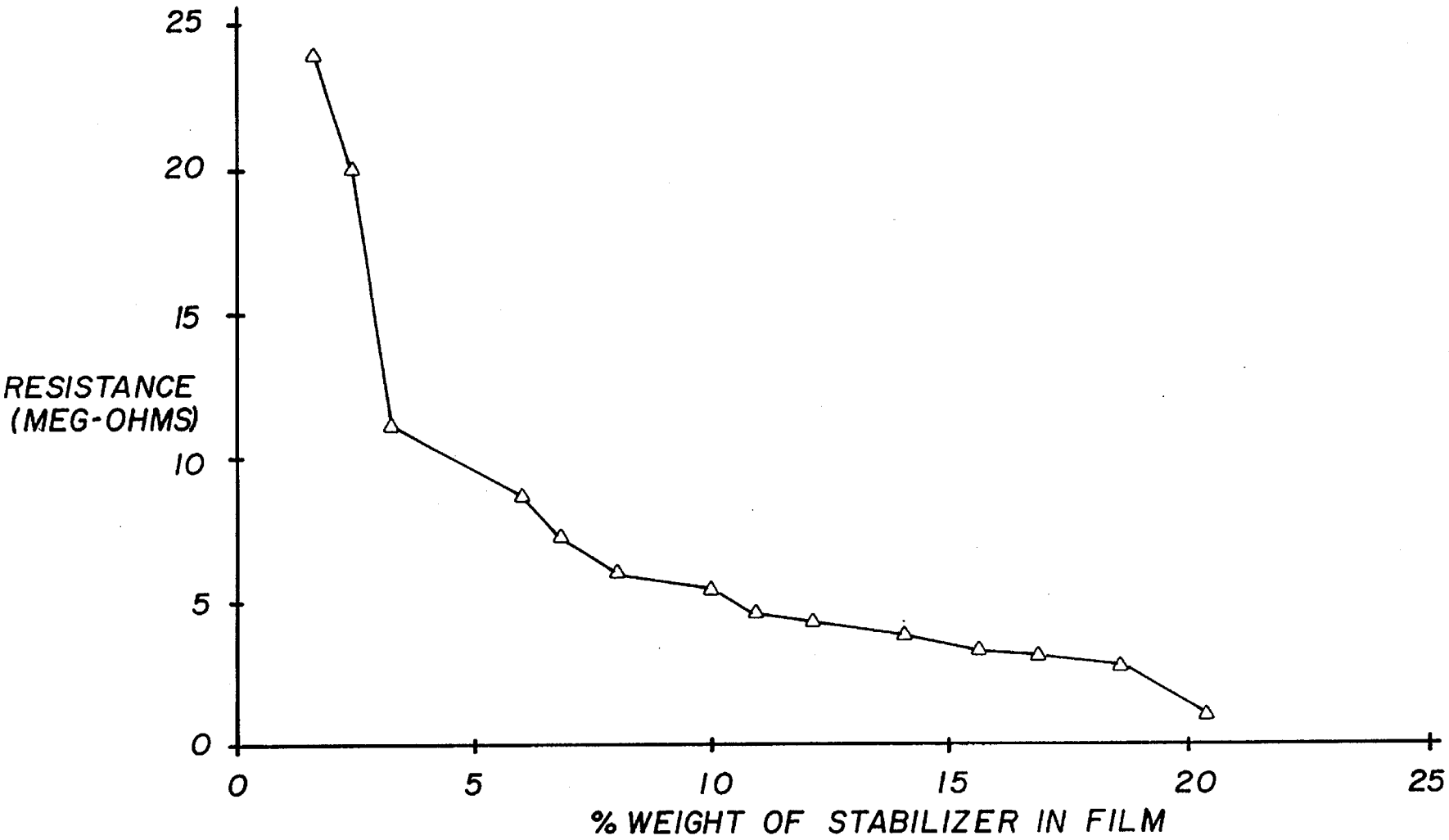
FIG. 3 is a graph of a photosensitive material conductivity drying profile illustrating the relationship between electrical resistance and percentage of photographic stabilizer absorbed during drying.

A controller 32 in communication with the sensors 26, 28, 30 and drying application devices 16, 18 regulates the drying application devices based on the sensed conductivity and the photosensitive material conductivity drying profile. By way of example, a photosensitive material drying profile is shown in FIG. 3 and illustrates the resistance of a photographic negative as a function of the weight of a stabilizer absorbed into the negative during drying. Following is a list of the empirically derived conductivity data represented by the photosensitive material conductivity drying profile of FIG. 3 wherein the subject negative had a weight of 0.466 g:

| Time | Wet Neg. Weight | Stab Weight | Resistance(y) | % Stabilizer(x) |
|---|---|---|---|---|
| 0 | .585 g | .199 g | 1.1 MΩ | 20.34 |
| 1 | .572 | .106 | 2.78 | 18.53 |
| 2 | .560 | .094 | 3.13 | 16.79 |
| 3 | .552 | .086 | 3.3 | 15.58 |
| 4 | .542 | .076 | 3.84 | 14.02 |
| 5 | .530 | .064 | 4.32 | 12.1 |
| 6 | .523 | .057 | 4.61 | 10.9 |
| 7 | .516 | .05 | 5.44 | 10.0 |
| 8 | .509 | .043 | 5.91 | 8.0 |
| 9 | .500 | .034 | 7.32 | 6.8 |
| 10 | .494 | .028 | 8.68 | 6.0 |
| 11 | .482 | .016 | 11.2 | 3.3 |
| 12 | .478 | .012 | 20.0 | 2.5 |
| 13 | .474 | .008 | 24.0 | 1.7 |
| 14 | .471 | .004 | — | .8 |

The drying profile created, was obtained by air drying film that was soaked in a photographic stabilizer. First, a negative strip was cut to the size of the distance D between the conductivity rollers 22, and weighed using a digital scale. The negative was then soaked in a heated & seasoned stabilizer solution for five minutes, reweighed and the electrical resistance was measured using an ohmmeter. The negative was allowed to air dry for one minute, and the weight and electrical resistance was measured once again. These measurements were recorded each minute until the negative was dry.

With continued reference to FIGS. 1 and 2, the controller 32 is programmable and has the photosensitive material conductivity drying profile of the photosensitive material 12 to be dried programmed therein. The controller 32 receives conductivity data from sensor 26 as the photosensitive material 12 begins its conveyance through dryer 10. Based on this sensed data, the controller 32 regulates drying application device 16 to dry the photosensitive material in accordance with the photosensitive material conductivity drying profile. In a preferred embodiment, controller 32 is in communication with a relay circuit 34 and the dryer apparatus 10 is designed to use the minimum amount of power required by the drying application device 16 to dry the photosensitive material according to the photosensitive material conductivity drying profile.

To control the heating application, the controller 32 can use such methods as frequency modulation to alter electrical current intensity going to drying application devices 16, 18. Relay 34, which is positioned between the controller 32 and drying application devices 16, 18, is a solid state switch capable of handling necessary levels of current. The amount of current going to devices 16, 18 is controlled by the frequency output of controller 32 which switches relay 34. Relay 34 is preferably positioned away from the control circuit because of the high levels of current and the amount of heat generated.

As the dried photosensitive material 12 arrives at second sensor 28, another conductivity measurement is sensed. If the photosensitive material 12 is not conductibly dry at this location, the controller 32 may be programmed to increase the power supplied to drying application device 16. This arrangement is useful in a dryer apparatus having only one drying application device.

In the embodiment illustrated, the photosensitive material dryer apparatus 10 also includes a second drying application device 18 in communication with the controller 32 and operable thereby for additional drying if required to satisfy the photosensitive material conductivity profile. If the photosensitive material 12 is insufficiently dry as sensed by sensor 28, the controller 32 activates drying application device 18 to further dry the photosensitive material as the material is conveyed thereby. As the photosensitive material arrives at third sensor 30, conductivity and thereby the dryness of the photosensitive material 12 is again sensed. Since there is no drying application device beyond sensor 30, sensor 30 is used as a check on the operation of the dryer 10. The data obtained from sensor 30 is used to adjust the drying of the photosensitive material 12 in accordance with its drying profile as becomes apparent.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

Parts List

10. photosensitive material dryer apparatus
12. photosensitive material
14. drying chamber
16. first drying application device
18. second drying application device
20. sets
22. upper conductivity roller
24. lower non-conductive roller
26. sensor
28. seonsor
30. sensor 32. controller 34. relay

What is claimed is:

1. A method of drying a photosensitive material following a wet chemical process, the photosensitive material having a photosensitive material conductivity drying profile; the photosensitive material being dried in a photosensitive material dryer including a drying chamber and a drying application device, the method characterized by:

electronically measuring the conductivity of the photosensitive material;

comparing the measured conductivity with the photosensitive material conductivity drying profile to determine the duration and amount of drying application required to dry the photosensitive material; and regulating said drying application device in response to the required drying application.

2. The method of claim 1 characterized in that electronically measuring includes measuring the conductivity between two spaced points.

3. The method of claim 2 characterized in that said regulating includes supplying the minimum amount of power to said drying application device required to dry the photosensitive material.

4. A method of drying a photosensitive material following a wet chemical process, in a photosensitive material dryer including a drying chamber and a drying application device, the method characterized by:

developing a photosensitive material conductivity drying profile;

electronically measuring the conductivity of the photosensitive material;

comparing the measured conductivity with the photosensitive material conductivity drying profile to determine the duration and amount of drying application required to dry the photosensitive material; and regulating said drying application device in response to the required drying application.

* * * * *